US008540459B2

(12) United States Patent
Patinet

(10) Patent No.: US 8,540,459 B2
(45) Date of Patent: Sep. 24, 2013

(54) STRUCTURE FOR LOADING AND UNLOADING AT LEAST ONE FLUID TRANSPORT SHIP

(75) Inventor: Jean-François Patinet, Villefranche de Lonchat (FR)

(73) Assignee: Technip France (FR)

( * ) Notice: Subject to any disclaimer, the term of this patent is extended or adjusted under 35 U.S.C. 154(b) by 236 days.

(21) Appl. No.: 12/989,457

(22) PCT Filed: Apr. 23, 2009

(86) PCT No.: PCT/FR2009/050754

§ 371 (c)(1),
(2), (4) Date: Jan. 13, 2011

(87) PCT Pub. No.: WO2009/138667

PCT Pub. Date: Nov. 19, 2009

(65) Prior Publication Data

US 2011/0094623 A1 Apr. 28, 2011

(30) Foreign Application Priority Data

Apr. 25, 2008 (FR) ..... 08 52814

(51) Int. Cl.
*E02D 29/02* (2006.01)
*B63B 35/40* (2006.01)

(52) U.S. Cl.
USPC ..... 405/195.1; 405/207

(58) Field of Classification Search
USPC ..... 114/49–55, 44, 230.1; 441/3–5; 405/203, 205, 207, 218–221, 224.1, 195.1
See application file for complete search history.

(56) References Cited

U.S. PATENT DOCUMENTS

| | | | | |
|---|---|---|---|---|
| 1,310,461 | A * | 7/1919 | Williams | 405/204 |
| 3,896,628 | A * | 7/1975 | Hansen | 405/207 |
| 4,321,882 | A * | 3/1982 | Sluys | 114/266 |
| 5,215,027 | A * | 6/1993 | Baxter | 114/266 |
| 6,082,931 | A * | 7/2000 | Hopper | 405/218 |
| 6,659,686 | B2 * | 12/2003 | Veazey | 405/16 |
| 7,762,205 | B1 * | 7/2010 | Veazey | 114/267 |

FOREIGN PATENT DOCUMENTS

| | | | |
|---|---|---|---|
| BE | 1010063 | A6 | 12/1997 |
| DE | 2901957 | A1 | 7/1980 |
| FR | 2674899 | A | 10/1992 |
| WO | WO 2006/041312 | A | 4/2006 |

OTHER PUBLICATIONS

International Search Report dated Dec. 15, 2009, issued in corresponding international application No. PCT/FR2009/050754.

* cited by examiner

*Primary Examiner* — S. Joseph Morano
*Assistant Examiner* — Anthony Wiest
(74) *Attorney, Agent, or Firm* — Ostrolenk Faber LLP

(57) ABSTRACT

A structure (20) for loading and unloading at least one fluid transport ship (1): a ship (1) mooring platform (21), comprising at least one concrete caisson (22) having an opening and closing device for moving the caisson by filling water, between a flotation position for transporting the platform, and a position anchored at the bottom of the sea. The platform comprises a submerged lower anchoring portion and an upper portion, partially outside of the water, for berthing the ship.

10 Claims, 5 Drawing Sheets

STRUCTURE FOR LOADING AND UNLOADING AT LEAST ONE FLUID TRANSPORT SHIP

CROSS REFERENCE TO RELATED APPLICATIONS

The present application is a 35 U.S.C. §371 National Phase conversion of PCT/FR2009/050754, filed Apr. 23, 2009, which claims benefit of French Application No. 08 52814, filed Apr. 25, 2008, the disclosure of which is incorporated herein by reference. The PCT International Application was published in the French language.

BACKGROUND OF THE INVENTION

The present invention relates to a structure for loading and unloading at least one ship for transporting a fluid, such as for example hydrocarbons, liquefied natural gas (LNG), liquefied petroleum gas (LPG) or any other liquefied gas.

The present invention applies in particular to the transfer of this type of product between a ship and a fixed structure consisting for example of a liquefaction unit or a regasification terminal when loading the ship, or a fluid reservoir when unloading the ship.

In view of certain constraints relating to safety and the movement of ships, it is preferable to carry out the fluid transfer operations while keeping the ship out of a port, in deeper waters, for example a few hundred meters away from the coast.

For carrying out such operations in open water, ship loading and unloading stations are known in particular which comprise a fluid transfer platform attached to the seabed by an attachment structure consisting of a set of piles driven into the seabed.

The platform supports articulated fluid transfer arms which are intended to be connected to pipe systems of the ship known as "manifolds" on the ship.

The known loading stations additionally comprise a set of mooring dolphins for absorbing the energy of berthing of the ship and the tide after berthing. The mooring dolphins are also attached to the seabed by rigid metal piles.

The fluid transfer platform is connected to a reservoir located on the coast or on a fixed platform at sea by a flexible conduit or pipeline that is partially or fully submerged.

This type of transfer platform requires a very large number of piles and is expensive and requires the use of heavy equipment for installation purposes.

Furthermore, due to their distance from the coast, this type of transfer platform is subject to the swell of the open sea and it is therefore necessary to orient them in such a way that, when the ship is moored at said platform, the ship faces towards the dominant swell. The "wind" factor must also be taken into account in the same way as the swell.

One aim of the invention is to propose a structure for loading and unloading at least one ship, which can be easily transported from a manufacturing site to the site of loading or unloading of the ship and can also be easily installed at this site, while withstanding waves of great height in extreme conditions.

SUMMARY OF THE INVENTION

The invention therefore relates to a structure for loading and unloading at least one fluid transport ship, characterised in that the structure is formed by a quay for mooring the ship, said quay comprising at least one concrete caisson equipped with closing and opening means for moving said caisson, by filling it with water, between a floating position for transporting the quay and a position anchored in the seabed, in which this caisson comprises a submerged lower part of said caisson for anchoring purposes and an upper part of said caisson, partially out of the water, for the berthing of said ship.

According to other features of the invention:

- the quay comprises a plurality of caissons placed end to end and connected to one another by complementary joining means,
- the lower part of said at least one caisson comprises at least one compartment equipped with closing and opening means,
- the lower part of said at least one caisson comprises a plurality of compartments, each equipped with closing and opening means,
- each closing and opening means is formed by a bottom plate of the compartment connected to means for displacing said bottom plate between a position of closing the corresponding compartment and a position of opening this compartment,
- the displacement means are formed by means for the step-by-step or continuous displacement of the bottom plate,
- said at least one compartment of the caisson comprises at least one member for locking the bottom plate in the closed position so as to keep said compartment sealed,
- the lower edge of the lower part of said at least one caisson comprises means for embedding the caisson in the seabed, and
- the embedding means are formed by orifices for spraying a pressurised fluid into the seabed.

BRIEF DESCRIPTION OF THE DRAWINGS

The invention will be better understood on reading the following description, given solely by way of example and with reference to the appended drawings, in which.

DESCRIPTION OF PREFERRED EMBODIMENTS

Figure 1:
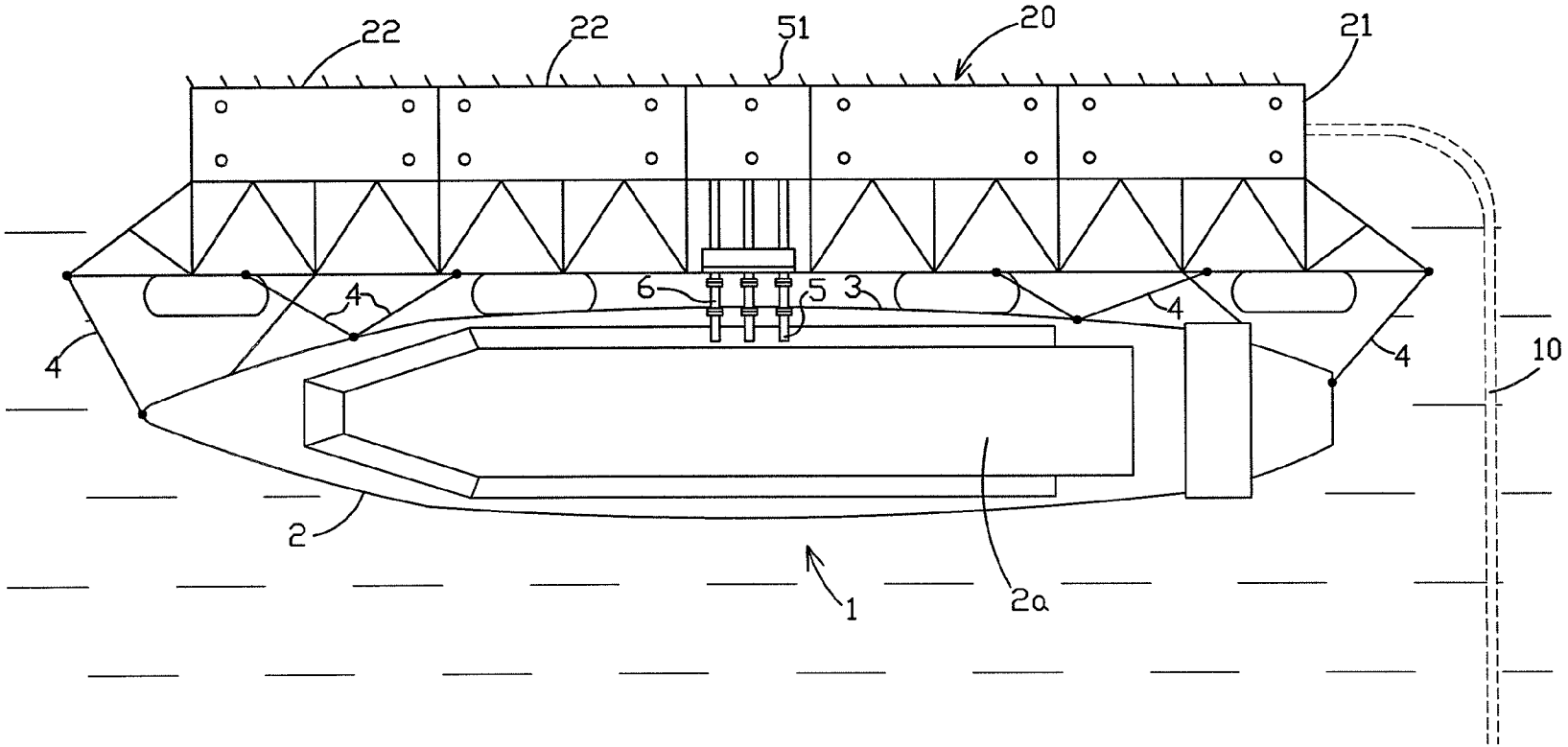
FIG. 1 is a schematic plan view of a loading and unloading structure according to the invention, after the mooring of a fluid transport ship.

FIG. 1 schematically shows a structure denoted by the general reference 20 for loading and unloading at least one ship 1 for transporting a fluid, such as for example liquefied hydrocarbons, in particular liquefied gas, such as liquefied natural gas (LNG), liquefied petroleum gas (LPG), or any other type of liquefied gas.

In a conventional manner, the ship 1 comprises a floating hull 2 delimiting a lateral mooring edge 3 and at least one reservoir 2*a* for storing the liquefied fluid. The ship 1 additionally comprises, along its mooring edge 3, mooring lines 4 attached respectively at the front, at the rear and in the middle part of the ship 1.

The reservoir 2*a* comprises a plurality of manifolds 5 which open transversely relative to the hull 2. Each manifold 5 is equipped at its outer end with a removable connector 6 for connecting it to a conduit 10 for transferring fluids to a terminal (not shown) which is arranged for example on the coast, or at sea, away from the structure 20, and which comprises reservoirs for storing liquefied hydrocarbons. The conduit 10, shown in dashed line in FIG. 1, is in this case a cryogenic conduit submerged in the expanse of water.

The structure 20 for loading and unloading the ship 1 will now be described with reference more particularly to FIGS. 1 to 3.

This structure 20 comprises a quay 21 for receiving and mooring the ship 1. This quay 21 comprises at least one concrete caisson 22 and, in the example of embodiment shown in FIG. 1, a plurality of caissons 22 placed end to end.

Figure 2:
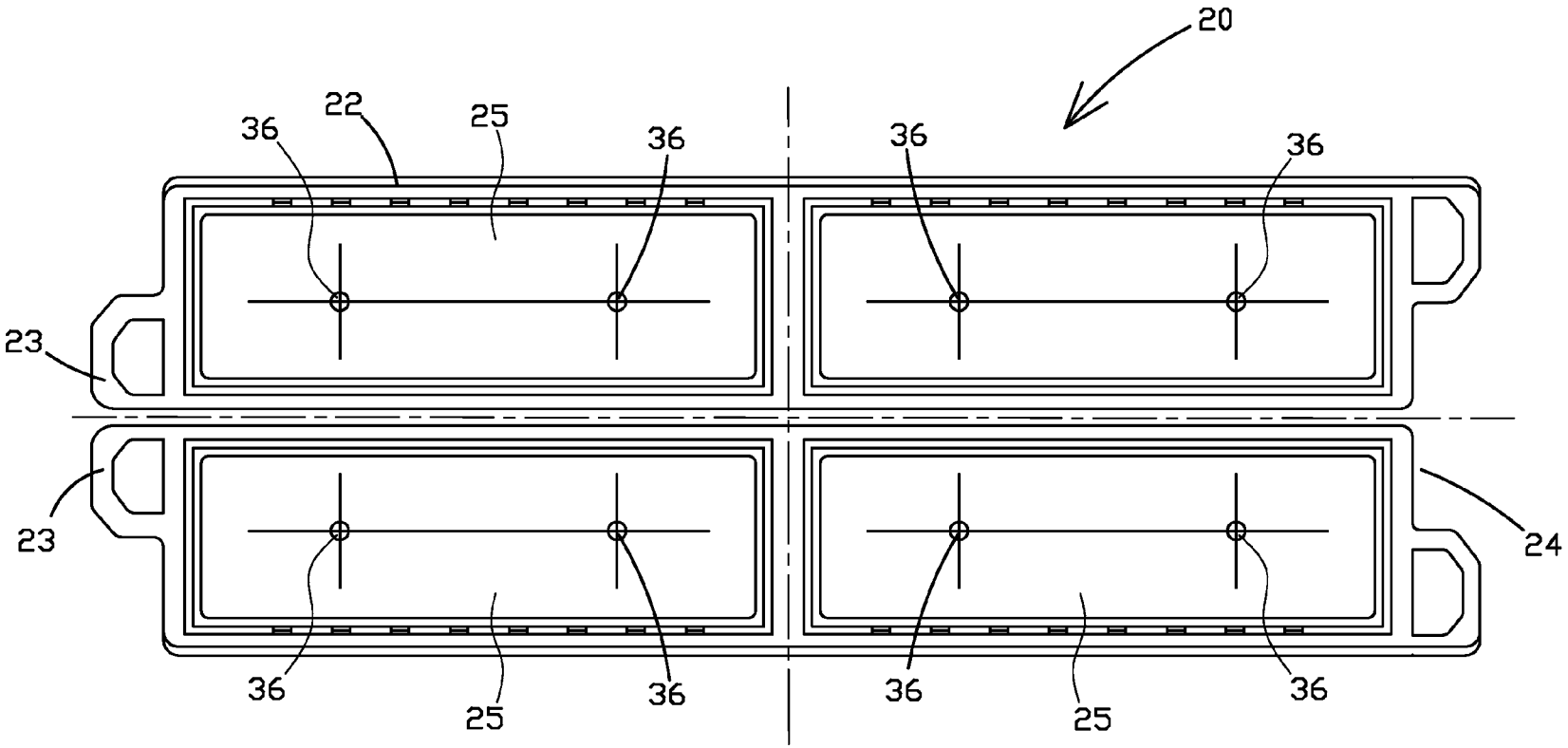
FIG. 2 is a schematic plan view of a concrete caisson of the loading and unloading structure according to the invention.

To this end, and as shown in FIG. 2, the end walls of each caisson 22 comprise complementary joining means which consist, on one of the end walls, of projecting elements 23 and, on the other opposite end wall, of a recessed part 24 intended to receive the projecting elements 23 of the adjacent caisson 22 when the caissons are placed one next to the other.

Figure 3:
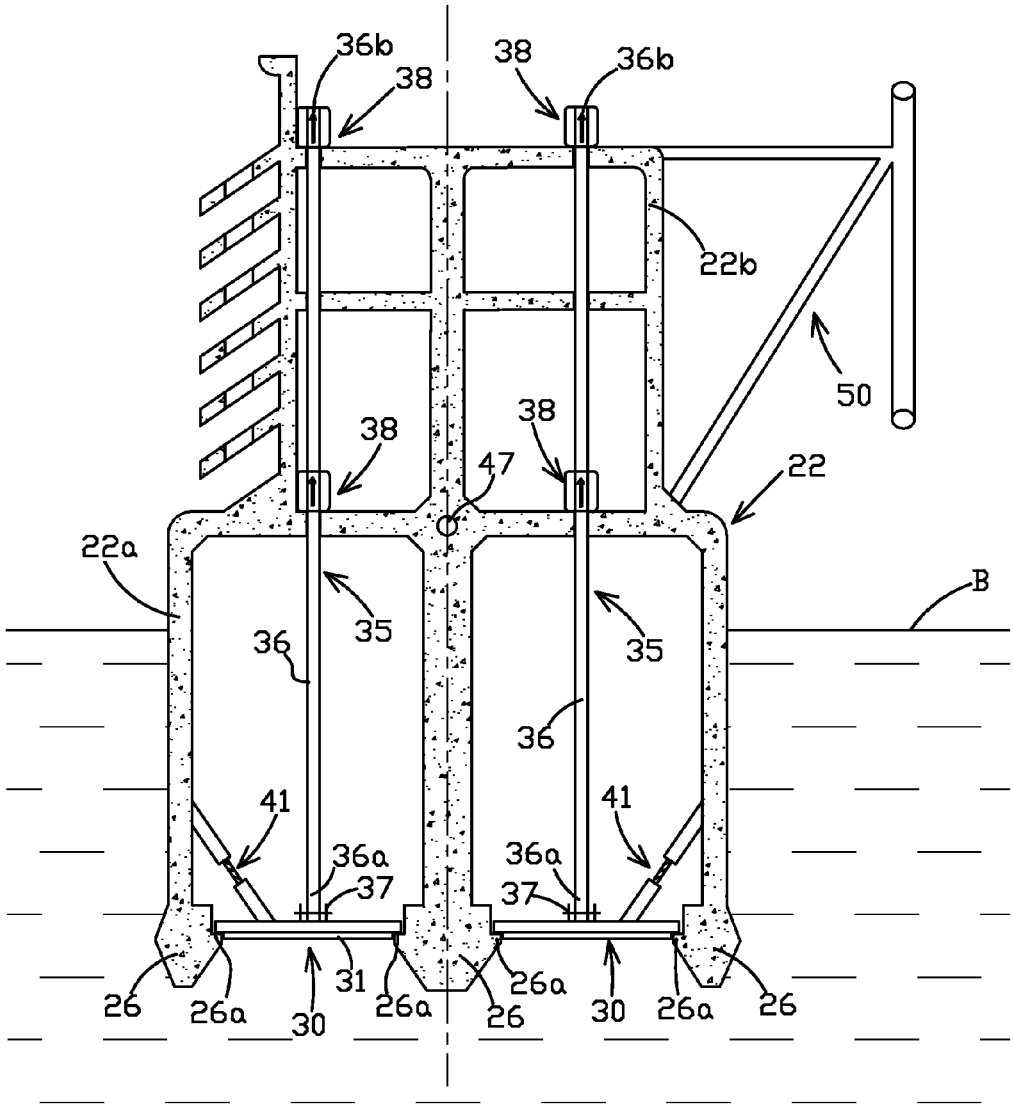
FIG. 3 is a schematic view in vertical section of the caisson of FIG. 2, in the floating position.
Figure 4:
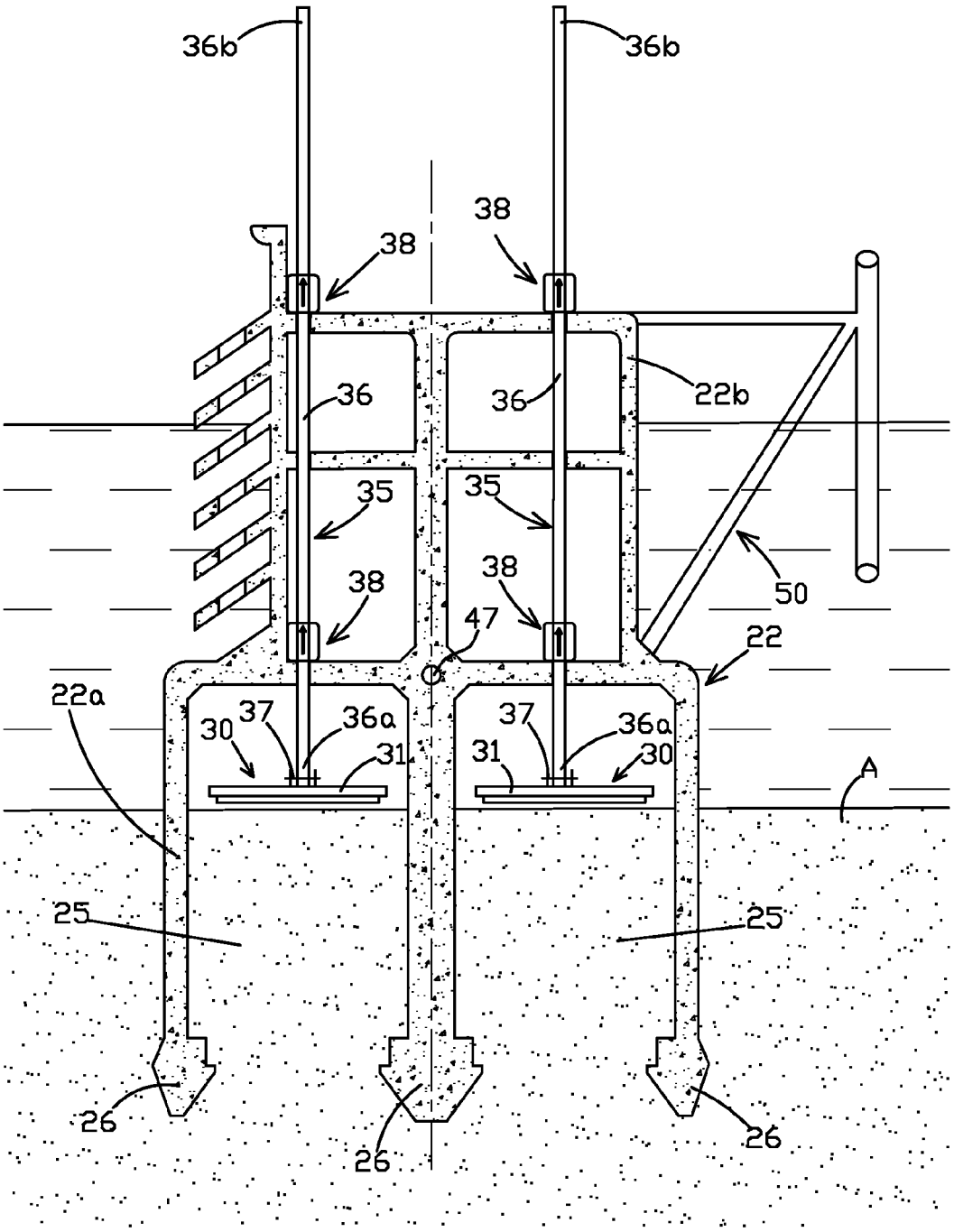
FIG. 4 is a schematic view of the caisson of FIG. 2, in the position anchored in the seabed.

Each concrete caisson 22 can be installed, by filling it with water, at an installation site in the open water, where each caisson 22 is anchored in the seabed A, as shown in FIG. 4, after transporting each caisson 22 in a floating position, as shown in FIG. 3, between a manufacturing site and the installation site.

Each caisson 22 comprises a lower part 22*a* making it possible to fill the caisson 22 with water, as will be seen below, and an upper part 22*b* forming technical sleeves for the passage for example of the conduits for connection (not shown) to the ship 1 or for the passage of any other member. The passage of the connecting conduits in the upper parts 22*b* of the caissons 22 thus makes it possible to protect these conduits from the swell and from any impact.

In the floating position shown in FIG. 3 the lower part 22*a* of the caisson 22 is sealed and is partially submerged and the upper part 22*b* is located above the water level B, and in the position anchored in the seabed A the lower part 22*a* of the caisson 22 is submerged and is partially embedded in the seabed A and the upper part 22*b* is partially out of the water for the purpose of berthing the ship 1.

The lower part 22*a* of the caisson 22 comprises at least one compartment 25 and, in the example shown in the figures, this lower part 22*a* comprises four compartments.

Each compartment 25 is equipped with closing and opening means 30 for moving the caisson 22, by filling it with water, between its floating position and its position anchored in the seabed A.

The means 30 for closing and opening each compartment 25 consists of a bottom plate 31 which is movable and which is connected to means 35 for displacing this bottom plate 31 between a position in which it closes the corresponding compartment 25 in a sealed manner and a position in which said compartment 25 is open. In the position in which it closes the compartment 25, the bottom plate 31 bears against a rim 26*a* formed on the lower edge 26 of the lower part 22*a* of the caisson 21, as shown in FIG. 3.

One means of displacing a bottom plate 31 will now be described with reference to FIGS. 3 to 5, each displacement means being identical and one bottom plate 31 being able to be associated with a plurality of displacement means 35.

Each displacement means 35 is formed by a rod 36 having a lower end 36*a*, connected to the corresponding bottom plate 31 by an articulation axle 37, and a free upper end 36*b*. The rod 36 passes through the lower part 22*a* and the upper part 22*b* of the caisson 22. The rod 36 carrying the bottom plate 31 can be displaced by step-by-step or continuous means.

In the case of step-by-step displacement means, these means consist of two assemblies 38, a first assembly 38 being placed above the lower part 22*a* and a second assembly 38 being placed above the upper part 22*b* of the caisson 22.

One assembly 38 will now be described with reference to FIG. 5, the other assemblies being identical.

Figure 5:
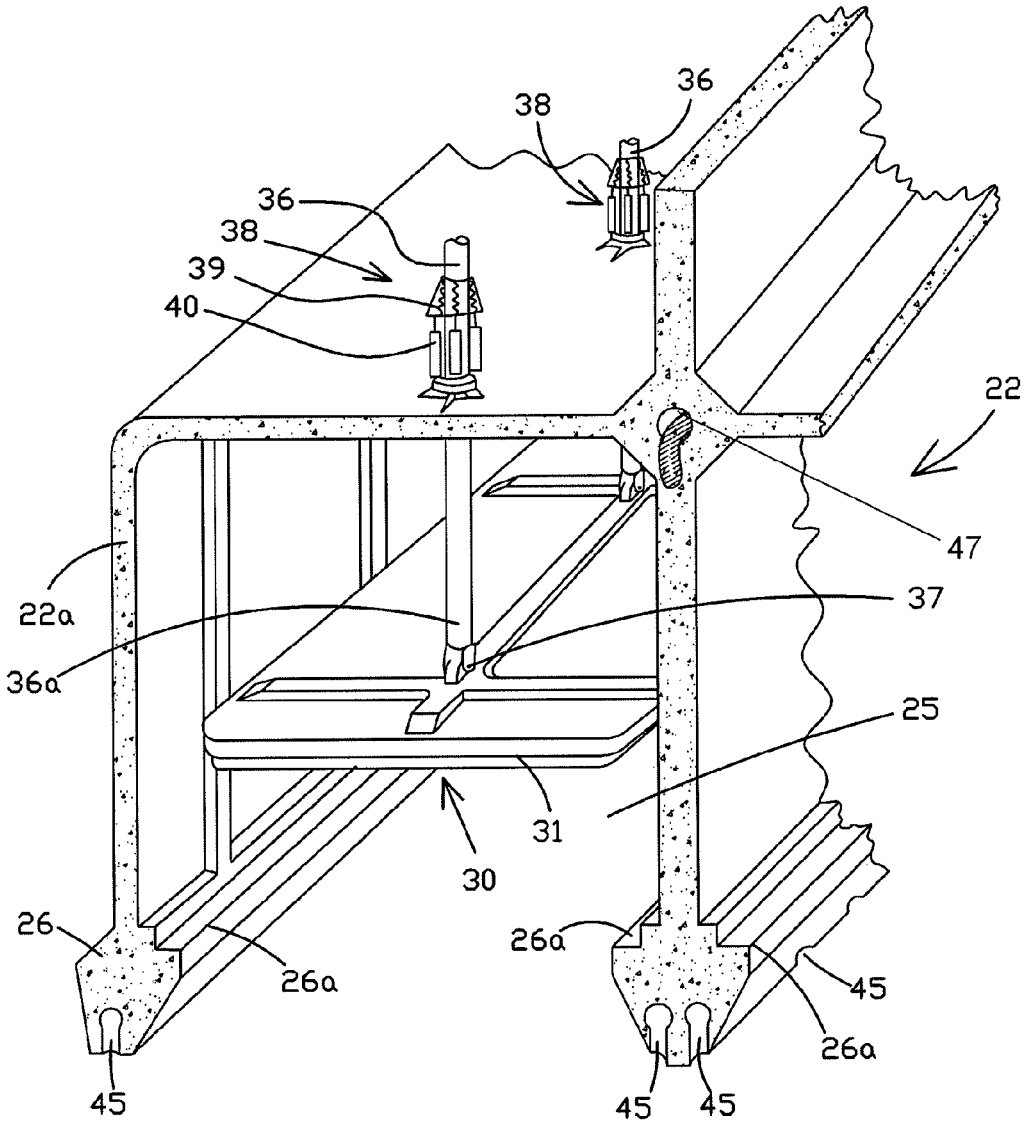
FIG. 5 is a schematic perspective view, partially cut-away, of the means for opening and closing a compartment of the caisson of the structure, according to the invention.

As shown schematically in FIG. 5, each assembly 38 comprises a plurality of jaws 39 which can be displaced transversely and perpendicular to the corresponding rod 36 between a position moved away from this rod 36 and a position clamped against said rod 36. Each assembly 38 also comprises cylinders 40 for displacing the jaws 39 vertically.

In the case of means for continuously displacing the rod 36 carrying a corresponding bottom plate 31, the displacement means consist for example of a rack-and-pinion assembly of the known type (not shown).

The displacement of each rod 36 may be carried out by any other suitable system.

As shown more particularly in FIG. 3, each bottom plate 31 is associated with at least one locking member 41 for locking this bottom plate 31 in the sealed closed position of the corresponding compartment 25. Each locking member consists for example of a screw-and-nut mechanism of the known type or of any other suitable mechanism.

In order to make it easier to anchor the caisson 22 in the seabed A, in addition to the intrinsic weight of the caisson, the lower edge 26 of the lower part of this caisson 22 comprises means for embedding the caisson 22 in the seabed A.

These embedding means, shown in FIG. 5, consist of orifices 45 for spraying a pressurised fluid into the seabed A. These orifices 45 are distributed along the length of the lower edge 26 of the caisson 22.

One of the side faces of the upper part 22*b* comprises a framework 50 formed of a trellis of beams on which the ship 1 is moored by means of mooring ropes 4, as shown in FIG. 1. On the side face opposite to the one carrying the framework 50, the upper part 22*b* of the caisson 22 comprises breakwaters 51.

The caissons 22 intended to form the quay 21 are installed at sea as follows. Each caisson 22 is brought in the floating state to the installation site. To this end, the bottom plate 31 of each compartment 25 is kept pressed against the rim 26*a* of the lower edge 26 so as to seal each compartment 25 of the caisson 22. The bottom plate 31 of each compartment 25 is kept in this position by at least one locking member 41, as shown in FIG. 3.

At the ship mooring site, two methods for anchoring the caissons 22 intended to form the quay 21 are possible.

First of all, the caissons 22 are oriented in such a way that the breakwaters 51 arranged on one side of the upper part 22*b* of the caisson 22 are oriented on the dominant swell side so as to break this swell and protect the ship 1 when it is moored at the quay 21.

The first method of submerging the caissons 22 consists of submerging each caisson 22 separately.

The locking member 41 for locking each bottom plate 31 is retracted in order to release this bottom plate 31.

The bottom plate 31 of each compartment 25 is then displaced from the position in which it closes the corresponding compartment 25 to the position in which it opens this compartment 25. To this end, the jaws 39 of the lower displacement assembly 38 are locked so as to lock the rod 36 carrying the bottom plate 31 that is to be opened. The jaws 39 of the upper displacement assembly 38 are unlocked on the corresponding rod 36 and the cylinders 40 of the upper displacement assembly 38 are actuated, which has the effect of displacing the rod 36 vertically upwards and of raising the bottom plate 31 of the corresponding compartment 25.

The water starts to penetrate into the compartment 25 and, after this first displacement of the rod 36 and of the bottom plate 31, the jaws 39 of the upper displacement assembly 38 are locked onto the rod 36. The jaws 39 of the lower displacement assembly 38 are unlocked and returned to their initial position by the cylinders 40.

The cylinders 40 of the upper displacement assembly 38 are then actuated so as to displace the rod 36 and the bottom plate 31 by a further step. A larger quantity of water thus penetrates into the compartment 25 of the lower part 22*a* of the caisson 22. The displacement of the rod 36 and of the corresponding bottom plate 31 thus takes place in successive steps.

The bottom plates 31 of the compartments 25 of the caisson 22 may be displaced in a synchronised manner or separately so that the caisson 22 gradually sinks and comes to lie on the seabed B. The caissons 22 intended to form the entire quay 21 are thus submerged one another the other and are placed on the seabed B.

The bringing-together and joining of the caissons one next to the other can be carried out by a system of cables and winches of the known type (not shown). To this end, a cable passes longitudinally through each caisson 22 via a longitudinal passage 47 (FIG. 5) formed between the parts, lower 22*a* and upper 22*b* respectively, of the caisson 22.

A second method of submerging the caissons 22 intended to form the quay 21 consists of assembling these caissons 22 one next to the other in the floating state.

The set of caissons 22 thus assembled is submerged, as above, by successively or simultaneously raising the bottom plates 31 of all the compartments 25 of the caissons 22.

As the caisson 22 is placed on the seabed A, this caisson 22 gradually becomes embedded in the seabed A under the effect of its own weight and this embedding is facilitated by spraying a pressurised fluid into the seabed A through the orifices 45. The bottom plates 31 of the compartments 25 are kept in the open position of each compartment 25, as shown in FIG. 4.

When the caissons 22 forming the quay 21 are thus anchored in the seabed A with the breakwaters 51 directed towards the dominant swell side, the conduits (not shown) provided in the upper part 22*b* of the caissons 22 of the quay 21 and intended for unloading a ship 1 after the latter has berthed are connected to the underwater conduit 10 so as to be able to transfer the fluid unloaded from the ship 1 towards the coast and towards a storage site.

The number of caissons 22 makes it possible to control and manage the descent of the quay as it is placed onto the seabed. This is because the greater the number of caissons 22, the more it is possible to open and/or close caissons in order to stabilise the descent of the quay as a whole.

According to one variant, the lower part 22*a* of the caissons 22 may be a cylindrical section and, in this case, the bottom plate 31 of each compartment 25 is curved.

The loading and unloading structure according to the invention has the advantage of being able to be brought to the loading or unloading site by floating and also of enabling a ship to berth in difficult conditions.

The structure according to the invention can be easily anchored at sea without it being necessary to drive in a multitude of piles and without any need to use heavy equipment in order to install it. A simple tug is sufficient for bringing the quay to the ship mooring site.

What is claimed is:

1. A structure for loading and unloading at least one fluid transport ship, the structure comprising a quay for mooring the ship, the quay comprising at least one concrete caisson equipped with closing and opening devices for moving the at least one caisson, by filling it with water, between a floating position, enabling transport of the quay, and a position anchored in the seabed, the at least one caisson comprising a submerged lower part of the at least one caisson for anchoring purposes and an upper part of the at least one caisson, configured to be partially out of the water, for berthing of the ship;

wherein the lower part of the at least one caisson comprises at least one compartment equipped with the closing and opening devices; and each of the closing and opening devices includes a bottom plate of the compartment connected to a displacing device configured for displacing the bottom plate between a position of closing the compartment and a position of opening the compartment, the position of the bottom plate opening the compartment allowing water to enter into the compartment.

2. The structure according to claim 1, wherein the quay comprises a plurality of the caissons placed end to end, and complementary joining devices connecting adjacent caissons to one another.

3. The structure according to claim 1, wherein the lower part of the at least one caisson comprises a plurality of the compartments, each equipped with respective ones of the closing and opening devices.

4. The structure according to claim 3, wherein each of the closing and opening devices includes a bottom plate of the compartment connected to a displacing device configured for displacing the bottom plate between a position of closing the compartment and a position of opening the compartment.

5. The structure according to claim 3, wherein the quay comprises a plurality of the caissons placed end to end, and complementary joining devices connecting adjacent caissons to one another.

6. The structure according to claim 1, wherein the displacement devices are configured for the step-by-step displacement of the bottom plate, or for continuous displacement.

7. The structure according to claim 1, wherein the at least one compartment of the caisson comprises at least one member for locking the bottom plate in the closed position so as to keep the compartment sealed.

8. The structure according to claim 1, wherein a lower edge of the lower part of the at least one caisson comprises a device configured for embedding the caisson in the seabed.

9. The structure according to claim 8, wherein the embedding device comprises orifices for spraying a pressurised fluid into the seabed.

10. The structure according to claim 1, wherein the upper part of the caisson comprises breakwaters on a side of the quay opposite a side thereof on which the ship berths.

* * * * *

UNITED STATES PATENT AND TRADEMARK OFFICE

CERTIFICATE OF CORRECTION

PATENT NO. : 8,540,459 B2
APPLICATION NO. : 12/989457
DATED : September 24, 2013
INVENTOR(S) : Jean-Fran|fcois Patinet It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 315 days.

Signed and Sealed this
Fifteenth Day of September, 2015

Michelle K. Lee

Michelle K. Lee
*Director of the United States Patent and Trademark Office*